US010906166B2

(12) United States Patent
Peters et al.

(10) Patent No.: US 10,906,166 B2
(45) Date of Patent: Feb. 2, 2021

(54) CONTROL METHOD AND PORTABLE POWER TOOL

(71) Applicant: Hilti Aktiengesellschaft, Schaan (LI)

(72) Inventors: Carsten Peters, Sax (CH); Helene Wesseler, Munich (DE); Markus Hartmann, Mauerstetten (DE); Klaus-Peter Bohn, Gams (CH); Thilo Hammers, Geltendorf (DE); Bastian Pluemacher, Schwabmuenchen (DE)

(73) Assignee: Hilti Aktiengesellschaft, Schaan (LI)

( * ) Notice: Subject to any disclaimer, the term of this patent is extended or adjusted under 35 U.S.C. 154(b) by 190 days.

(21) Appl. No.: 16/061,990

(22) PCT Filed: Dec. 6, 2016

(86) PCT No.: PCT/EP2016/079809
§ 371 (c)(1),
(2) Date: Jun. 13, 2018

(87) PCT Pub. No.: WO2017/102415
PCT Pub. Date: Jun. 22, 2017

(65) Prior Publication Data

US 2018/0370008 A1 Dec. 27, 2018

(30) Foreign Application Priority Data

Dec. 14, 2015 (EP) ..... 15199870

(51) Int. Cl.
*B25D 16/00* (2006.01)
*B25D 11/06* (2006.01)
(Continued)

(52) U.S. Cl.
CPC ..... *B25D 16/006* (2013.01); *B25D 11/062* (2013.01); *B25D 17/06* (2013.01);
(Continued)

(58) Field of Classification Search
CPC .... B25D 11/062; B25D 16/006; B25D 17/06; B25D 2216/003; B25D 2222/42;
(Continued)

(56) References Cited

U.S. PATENT DOCUMENTS 4,732,218 A * 4/1988 Neumaler et al. ..... B23B 45/16 173/105
6,640,205 B2 * 10/2003 Bongers-Ambrosius ..... B25D 16/00 408/8
2007/0107919 A1 * 5/2007 Strasser ..... B25B 21/02 173/1

FOREIGN PATENT DOCUMENTS

DE 199 61 586 A1 7/2001
DE 103 09 414 A1 9/2004
(Continued)

OTHER PUBLICATIONS

PCT/EP2016/079809, International Search Report (PCT/ISA/220 and PCT/ISA/210) dated Feb. 3, 2017, with partial English translation, enclosing Written Opinion of the International Searching Authority (PCT/ISA/237) Fourteen (14) pages).

*Primary Examiner* — Thanh K Truong
*Assistant Examiner* — David G Shutty
(74) *Attorney, Agent, or Firm* — Crowell & Moring LLP

(57) ABSTRACT

A control method for a bore-chiseling portable power tool for machining a substrate by a drill bit includes superimposing a periodic striking on the drill bit at an impact rate and a rotating of the tool holder at a rotational speed in a rotational direction, identifying a material of the substrate being machined by the drill bit by a sensor, adjusting the rotational speed and/or the rotational direction to a first rotational speed and a first rotational direction when the identified material is an iron-based material, and adjusting the rotational speed and/or the rotational direction to a
(Continued)

second rotational speed and a second rotational direction when the identified material is a mineral material. The first rotational speed is less than the second rotational speed and the first rotational direction is counter-clockwise and the second rotational direction is clockwise.

7 Claims, 1 Drawing Sheet

(51) Int. Cl.
*B25D 17/06* (2006.01)
*B25F 5/00* (2006.01)

(52) U.S. Cl.
CPC ..... *B25F 5/006* (2013.01); *B25D 2216/003* (2013.01); *B25D 2222/42* (2013.01); *B25D 2222/72* (2013.01); *B25D 2250/201* (2013.01); *B25D 2250/221* (2013.01)

(58) Field of Classification Search
CPC ..... B25D 2222/72; B25D 2250/201; B25D 2250/221; B25F 5/006
See application file for complete search history.

(56) References Cited

FOREIGN PATENT DOCUMENTS

| | | | | |
|---|---|---|---|---|
| EP | 0 847 837 | A2 | 6/1998 | |
| WO | WO-0145908 | A1 * | 6/2001 | ..... B25D 16/00 |

* cited by examiner

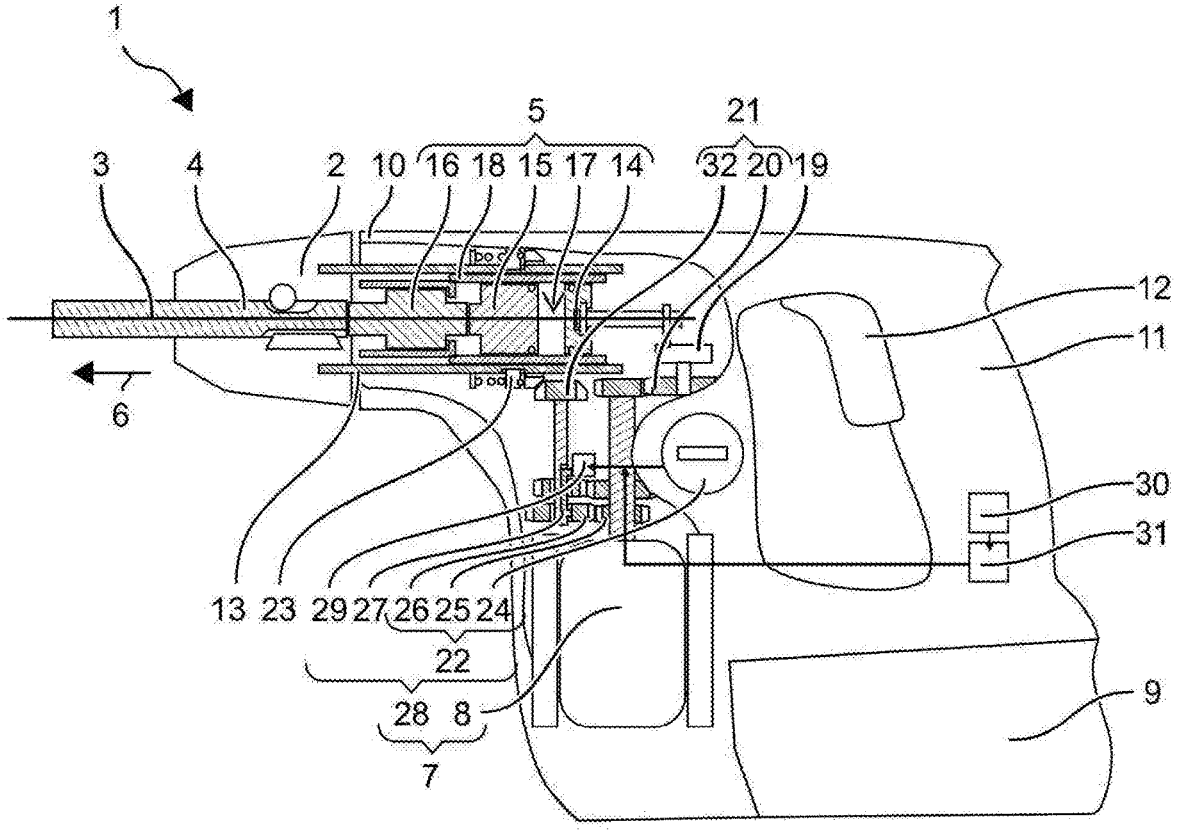
1
5
21
3
4
2
10
16
18
15
17
14
32
20
19
12
11
6
30
31
13
23
29
27
26
25
24
22
28
8
7
9

CONTROL METHOD AND PORTABLE POWER TOOL

CROSS REFERENCE TO RELATED APPLICATIONS

This application claims the priority of International Application No. PCT/EP2016/079809, filed Dec. 6, 2016, and European Patent Document No. 15199870.5, filed Dec. 14, 2015, the disclosures of which are expressly incorporated by reference herein.

BACKGROUND AND SUMMARY OF THE INVENTION

The present invention relates to a control method for a bore-chiseling portable power tool, which simultaneously rotates a drill bit and exerts blows longitudinally on the drill bit.

U.S. Pat. No. 4,732,218 describes a hammer drill. The hammer drill has a pneumatic striking mechanism, which exerts blows on a drill bit periodically. The drill bit is also rotated about its longitudinal axis. The hammer drill is used in particular to drill bore holes in mineral construction materials, e.g., concrete. The drill bits used are therefore optimized for working on mineral construction materials. However, the drill bit can strike a rebar. The drilling progress is then very slow.

U.S. Pat. No. 6,640,205 describes a hammer drill, which examines returning shock waves while cutting into a substrate. Based on the shock waves, a material composition of the substrate is identified.

The control method according to the invention is for a bore-chiseling portable power tool for machining a substrate by means of a drill bit. The portable power tool has a tool holder for holding a drill bit on a work axis, a rotatory drive for rotating the tool holder about the work axis, and a striking mechanism to exert blows on the drill bit. The control method has the steps: superimposing periodic percussion on the drill bit at an impact rate and rotating the tool holder at a rotational speed in a rotational direction; identifying a material of the substrate machined by the drill bit; and adjusting the rotational speed and/or rotational direction based on the identified material, wherein for an iron-based material, the rotational speed is adjusted to a first value and a first rotational direction, wherein for a mineral material the rotational speed is adjusted to a second value and a second rotational direction, and wherein the first value is less than the second value or the first rotational direction is counterclockwise and the second rotational direction is clockwise.

The portable power tool initially detects what material is currently being machined by the drill bit. For mineral material, the portable power tool is operated in standard operating mode with typical maximum impact performance and rotational performance. For an iron-based material, the rotational performance is reduced. The drilling dust is no longer effectively carried out of the bore hole. Part of the mineral drilling dust remains in the vicinity of the bore head, which contributes to more effective cutting of the iron-containing material, e.g., the rebar.

One design provides that an impact rate of the striking mechanism is independent of the rotational speed and/or rotational direction. Preferably, the impact rate differs by less than 20% for iron-based material and mineral material respectively. Effective cutting of both mineral—as well as iron-based material is achieved at a maximum impact performance. One design provides that the translation angle of the tool holder between two sequential strikes is between 1 degree and 10 degrees for the first rotational speed and greater than 30 degrees for the second rotational speed.

A portable power tool according to the invention has a tool holder for holding a bore-chiseling drill bit on a work axis, an electric motor, a striking mechanism that has a striker moved along the work axis at an impact rate, a rotary drive, which rotationally drives the tool holder at a rotational speed in a rotational direction. A control device is arranged for adjusting the rotational speed and/or rotational direction independently of the impact rate of the striking mechanism. The portable power tool can change the rotational speed or the rotational direction automatically or have the change induced by the user to adapt the portable power tool in a suitable manner to the substrate; in both operating modes, supported by an efficiently impacting striking mechanism. The striking mechanism is preferably a pneumatic striking mechanism driven by the electric motor.

The following description explains the invention by means of illustrative embodiments and the FIGURE.

BRIEF DESCRIPTION OF THE DRAWING

The FIGURE illustrates a hammer drill.

DETAILED DESCRIPTION OF THE DRAWING

The FIGURE depicts a hammer drill 1 as an example of a percussive portable power tool. Hammer drill 1 has a tool holder 2, in which a drill bit, chisel, or other percussive drill bit 4 can be inserted coaxially to a work axis 3 and locked. Hammer drill 1 has a pneumatic striking mechanism 5, which can exert periodic blows in an impact direction 6 on drill bit 4. A rotary drive 7 can continually rotate tool holder 2 about work axis 3. Pneumatic striking mechanism 5 and the rotary drive are driven by an electric motor 8, which is supplied with electricity from a battery 9 or a power cable.

Striking mechanism 5 and rotary drive 7 are arranged in a machine housing 10. A handle 11 is typically arranged on one side of machine housing 10 facing away from tool holder 2. The user can hold and guide hammer drill 1 while in operation by means of handle 11. An additional auxiliary handle may be attached near tool holder 2. On or near handle 11, there is arranged an operating switch 12, which the user can actuate preferably with the holding hand. Electric motor 8 is switched on by actuating operating switch 12. Typically, electric motor 8 rotates as long as operating switch 12 is pressed down.

Drill bit 4 is moveable in tool holder 2 along work axis 3. For example, drill bit 4 has a longitudinal groove, in which a ball or other spherical body of tool holder 2 engages. The user holds drill bit 4 in a work position, in which the user presses drill bit 4 indirectly through hammer drill 1 against a substrate. Drill bit 4 has a drill head of sintered metal carbide and a spiral for carrying away drilling dust from the bore hole.

Tool holder 2 is attached to a spindle 13 of rotary drive 7. Tool holder 2 can rotate in relation to machine housing 10 about work axis 3. Jaws or other suitable means in tool holder 2 transmit a torque from tool holder 2 to drill bit 4.

The pneumatic striking mechanism has an exciter 14, a striker 15, and a ram 16 along impact direction 6. Exciter 14 is forced by means of electric motor 8 into a periodic movement along work axis 3. Exciter 14 is linked by means of a gear component 44 for translating the rotational movement of electric motor 8 into a periodic, translational movement along work axis 3. An illustrative gear component includes an eccentric wheel or a swashplate. A period of the translational movement of exciter 14 is specified by the rotational speed of electric motor 8 and if applicable a gear reduction ratio in the gear component.

Striker 15 is coupled to the movement of exciter 14 by means of a pneumatic spring. The pneumatic spring is formed by an enclosed pneumatic chamber 17 between exciter 14 and striker 15. Striker 15 moves in impact direction 6 until striker 15 strikes ram 16. Ram 16 lies in strike direction 6 against drill bit 4 and transmits the impact to drill bit 4. The period of the movement of the striker is identical to the period of the movement of exciter 14. Striker 15 thus strikes at an impact rate that is equal to the inverse of the period. The operating principle of the pneumatic spring sets narrow limits for the period or the impact rate, since the efficiency of the pneumatic coupling is dependent on an essentially resonant excitation. Given a deviation of more than 20% from an optimal impact rate, striker 15 typically no longer follows the movement of exciter 14. The optimal impact rate is specified by the mass of striker 15 and the geometric dimensions of pneumatic chamber 17. An optimal impact rate is between 25 Hz and 100 Hz.

Illustrative striking mechanism 5 has a piston-shaped exciter 14 and a piston-shaped striker 15, which are guided through a guide tube 18 along work axis 3. Outer surfaces of exciter 14 and striker 15 contact the interior surface of guide tube 18. Pneumatic chamber 17 is enclosed by exciter 14 and striker 15 along work axis 3 and by guide tube 18 in a radial direction. Sealing rings in the outer surfaces of exciter 14 and striker 15 can improve the air-tight seal of pneumatic chamber 17. Exciter 14 is driven by electric motor 8. Eccentric wheel 19 or a different turning means converts the rotational movement of electric motor 8 into the periodic translational movement of exciter 14. Eccentric wheel 19 is connected to electric motor 8 via a partial section 20 of a drive train 21.

Rotary drive 7 contains spindle 13, which is arranged coaxially to work axis 3. Spindle 13 is hollow for example, and striking mechanism 5 is arranged inside the spindle. Tool holder 2 is set on spindle 3. Tool holder 2 may be detachably or permanently connected to spindle 13 via a locking mechanism. Spindle 13 is connected to electric motor 8 via a reduction gear 22. The rotational speed of spindle 13 is less than the rotational speed of electric motor 8. A slide coupling 23 may be placed between reduction gear 22 and spindle 13.

Spindle 13 preferably rotates continually at a specified rotational speed. The rotational speed is specified by reduction gear 22. Reduction gear 22 has two different reduction ratios. The first reduction ratio is optimized for cutting mineral rock using a conventional drill bit 4. In the first reduction ratio, the rotational speed of spindle 13 is in a range between 200 revolutions per minute (rpm) and 1,000 rpm, and spindle 13 rotates clockwise. With the impact rate, independent of reduction gear 22, of pneumatic striking mechanism 5, rotation between two sequential impacts of drill bit 4 is by a rotation angle of more than 30 degrees and not more than 75 degrees. The typical rotation angle causes the drilling dust to be efficiently carried off from the bore hole using conventional drill bits 4.

The second reduction ratio is provided for cutting iron-based materials, e.g., a rebar. The rotational speed is significantly reduced compared to the first reduction ratio; for example, the rotational speed is below 20 rpm. Striking mechanism 5 strikes periodically in a superimposed manner to the rotational movement at an impact rate of more than 5 blows per second on drill bit 4. A translation angle of drill bit 4 between two strikes is preferably below 10 degrees, for example less than 5 degrees, preferably more than 1 degree. The spiral of drill bit 4 carries less drilling dust or no longer carries it out of the bore hole. Alternatively, the second reduction ratio may cause a counter-clockwise rotation of spindle 13. Drill bit 4 carries the drilling dust into the bore hole instead of carrying it out. The drilling dust remaining in the bore hole proves to be advantageous for carrying off rebar using drill bit 4.

Preferably, the user can actuate reduction gear 22 with a selector switch 24. The user can recognize for example from an impact-decreasing drilling progress that a rebar is being machined or from an impact-increasing drilling progress that mineral material is being machined again. Selector switch 24 has at least two switch positions. A first switch position is for the superimposed drilling- and chiseling-type cutting of mineral material; a second switch position is for the superimposed drilling- and chiseling-type cutting of iron-containing material. In the first switch position, reduction gear 22 is switched over in the first reduction ratio and in the second switch position, reduction gear 22 is switched over into the second reduction ratio. The impact rate of pneumatic strike mechanism 5 is the same or almost the same in both switch positions; preferably, striking mechanism 5 operates in both switch positions at the highest efficiency or maximum cutting performance. In an alternative design, the operating direction of spindle 13 in the second switch position is set in a counter-clockwise direction to decrease the removal of the drilling dust.

The FIGURE depicts an illustrative reduction gear 22 in the form of a spur gear. Two sprockets 25 with different diameters are attached to an input shaft; two gearwheels 26 are seated on an output shaft. The gearwheels are permanently engaged with one of the two sprockets, for example. A linear cam 27 couples in each case one of the gearwheels to the output shaft. The linear cam can also be arranged on the input shaft. Furthermore, a switching of gear 22 can occur by an axial displacement of the sprockets or gearwheels. The gear can also be executed as a planetary gear. Two of the components out of a ring gear, planetary carrier, and sun gear are connected to the input shaft and the output shaft. Depending on the switch position, a switchable brake allows the remaining third component to rotate freely or impedes its rotation.

A control device 28 can switch gear 22 manually. Control device 28 contains for example selector switch 24. A mechanical linkage transmits the position of selector switch 24 to gear 22. Control device 28 can alternatively switch gear 22 by means of an actuator 29. Actuator 29 can be designed to be electromagnetic, piezo-electric, hydraulic, pneumatic, and so on. Actuator 29 actuates linear cam 27, displaces the sprockets or gearwheels, or activates the brake. Control device 28 can automatically switch gear 22. A sensor 30 detects the suitable gear ratio for gear 22 and switches gear 22 using actuator 29.

Hammer drill 1 can automatically detect the substrate that drill bit 4 strikes. The blows of drill bit 4 on the mineral rock are more strongly dampened than the blows of drill bit 4 on iron-containing rebar. Drill bit 4 and hammer drill 1 thus experience a different return force for the two materials. The vibrations in hammer drill 1 are significantly higher for an iron-containing material than for rock.

Illustrative hammer drill 1 has sensor 30 to record vibrations. Sensor 30 is preferably rigidly connected to striking mechanism 5 or machine housing 10. An illustrative sensor 30 has a free-swinging arm, on which a piezo-electric polymer film is applied. When excited and as a result of the vibrations, the arm generates an electric signal, which sensor 30 evaluates. Sensor 30 can be an acceleration sensor, which gives out acceleration values as a dimension for vibrations. The sensor can also be a microphone, preferably for detecting noises in the subsonic range.

Sensor 30 compares the vibrations against a threshold value. Exceeding the threshold value is assigned to boring in iron-containing material and falling below the threshold value is assigned to boring in mineral material. The threshold value depends on the impact performance of striking mechanism 5 and can be determined by test series. Sensor 30 or a microprocessor 31 can undertake the evaluation of the vibrations. The threshold value can be stored in microprocessor 31. Instead of a simple comparison against a threshold value, one can discriminate between drilling of rock from the drilling of iron-containing material by means of a more complex profile. The vibrations can be determined in one or more frequency ranges. One frequency range has the impact rate as the middle frequency for example, and a bandwidth of no more than half the impact rate, for example. Likewise, the first harmonic frequency of the impact rate can be the middle frequency of a frequency range.

Hammer drill 1 automatically switches reduction gear 22 as a function of the material detected by sensor 30. In particular, a rapid decrease of the rotational speed is desired if drill bit 4 strikes a rebar. Otherwise, drill bit 4 can still completely remove the drilling dust from the bore hole. Sensor 30 transmits a corresponding control signal to actuator 29.

The removal of drilling dust from the bore hole may also be prevented by changing the rotational direction of drill bit 4. Due to the clockwise-handedness of the drill bit spiral, drill bits 4 transport the drilling dust out of the bore hole only in a clockwise rotation of tool holder 2. The machining of rebar can take place instead of or in addition to a decreased rotational speed with a counter-clockwise rotation of tool holder 2. The change in rotational direction can occur for example using electric motor 8, since striking mechanism 5 operates essentially independently of the rotational direction of electric motor 8.

Gear 22 has no influence on the rotational speed of eccentric wheel 19 or the movement of exciter 14. Drive train 21 branches out into a first partial section 20 for pneumatic striking mechanism 5 and into a partial second section 32 for spindle 13. Gear 22 is arranged in second partial section 32.

The invention claimed is:

1. A control method for a bore-chiseling portable power tool for machining a substrate by a drill bit, wherein the portable power tool has a tool holder for holding the drill bit on a work axis, a rotary drive for rotating the tool holder about the work axis, and a striking mechanism for striking the drill bit, comprising the steps of:

superimposing a periodic striking on the drill bit at an impact rate and a rotating of the tool holder at a rotational speed in a rotational direction;

identifying a material of the substrate being machined by the drill bit by a sensor;

adjusting the rotational speed and the rotational direction to a first rotational speed and a first rotational direction when the material is an iron-based material; and adjusting the rotational speed and the rotational direction to a second rotational speed and a second rotational direction when the material is a mineral material;

wherein the first rotational speed is less than the second rotational speed and the first rotational direction is counter-clockwise and the second rotational direction is clockwise.

2. The control method according to claim 1, wherein the impact rate is independent from the material.

3. The control method according to claim 1, wherein respective impact rates for the iron-based material and the mineral material differ by less than 20%.

4. The control method according to claim 1, wherein a translation angle of the tool holder between two sequential strikes on the drill bit is between 1 degree and 10 degrees for the first rotational speed and is greater than 30 degrees for the second rotational speed.

5. The control method according to claim 1, wherein the sensor records vibrations of the portable power tool and the material is identified based on a characteristic signature of the vibrations.

6. The control method according to claim 5, further comprising comparing an amplitude of the vibrations against a threshold value, and identifying the material as the mineral material when the amplitude falls below the threshold value and identifying the material as the iron-based material when the amplitude exceeds the threshold value.

7. The control method according to claim 1, wherein a reduction gear of the rotary drive is switched in response to an identified change of the material to adjust the rotational speed.

* * * * *